United States Patent [19]

Sullivan

[11] 4,285,034

[45] Aug. 18, 1981

[54] ENCLOSED INDUSTRIAL LUMINAIRE

[75] Inventor: Daryl D. Sullivan, Newark, Ohio

[73] Assignee: Johns-Manville Corporation, Denver, Colo.

[21] Appl. No.: 48,287

[22] Filed: Jun. 13, 1979

[51] Int. Cl.[3] ..... F21V 7/00

[52] U.S. Cl. ..... 362/305; 362/147; 362/346; 362/350

[58] Field of Search ..... 362/297, 348, 147, 305, 362/346, 350

[56] References Cited

U.S. PATENT DOCUMENTS 4,181,930 1/1980 Mewissen et al. ..... 362/350 X

*Primary Examiner*—Stephen J. Lechert, Jr.

*Attorney, Agent, or Firm*—Robert M. Krone; Joseph J. Kelly

[57] ABSTRACT

The present invention relates to a luminaire and more particularly a downlight for industrial lighting applications. Energy considerations, lowered ceiling heights, and greater demand for illumination uniformity has resulted in a demand for a versatile and efficient downlight. The present invention anticipates providing a reflector, lamp, and refractive lens construction which utilizes an incrementally painted reflective surface to provide a versatile spacing between each downlight in an array, using the same basic downlight configuration. The refractive lens includes prismatic refractor elements which reshape the downwardly directed conical beam of light to provide even more uniform illumination when used in conjunction with the plurality of such downlights arrayed in an industrial lighting situation.

11 Claims, 4 Drawing Figures

ENCLOSED INDUSTRIAL LUMINAIRE

TECHNICAL FIELD

The present invention relates to luminaires and in a particular luminaires utilizing optical systems to optimize the illumination from a high intensity discharge lamp. Such optical systems employ a reflector, usually having a reflective surface in the shape of a surface of revolution, combined with a refractor element, called a lens, for controlling the light from both the reflector and directly from the lamp itself. More particularly, the present invention relates to luminaires suspended from the ceilings of industrial buildings wherein the light therefrom is directed downwardly to illuminate the floor or work plane within the industrial building.

One aspect of efficiently utilizing the light from such an optical system embodied in the downwardly suspended luminaire is the proper spacing of the series of such luminaires to provide a generally uniform illumination to the floor or work plane. In the usual design, such a luminaire produces a cone of light emanating from the luminaire downwardly to the area to be illuminated. If, as is the usual case, such a cone of light would be inadequate to light the entire area of the industrial setting, a plurality of similar luminaires are positioned, usually in a grid distribution, to provide adequate lighting for the entire working area of the building. The height above the floor at which the luminaires are to be suspended is one factor which determines how close the luminaires must be hung relative to one another to provide the required uniform illumination. The ratio of the spacing between adjacent luminaires to the mounting height from the floor is a performance parameter characteristic of each particular luminaire. The larger this ratio is, the fewer luminaires ae needed to light a particular work area in a uniform manner.

BACKGROUND OF PRIOR ART

In the past such downwardly directed luminaires, hereinafter referred to as downlights, have provided a generally right circular cone of light which, because of its particular shape, is able to satisfy particular spacing requirements. That is, for a particular downlight, the distance between adjacent downlights relative to the height above the work plan was relatively fixed. One such downlight, marketed by the assignee of the present application, is a luminaire marketed by Holophane under the trade designation LOBAY PRISMPACK I. This downlight has a reflector having generally a shape of a surface of revolution. The inner reflective surface is provided with a white baked enamel finish. Below the lamp, positioned along the axis of the reflector is a refractive lens which, because of its particular characteristics modifies the light (emanating directly from the lamp and being reflected from the white reflective surface of the reflector) to control light therefrom and redirect it in a generally downwardly direction. This reduces glare producing light, i.e., light which would emanate from the light/reflector combination at relatively high angles to nadir. Preferably this lens is an acrylic REFRACTIVE GRID lens (registered trademark of the Johns-Manville Corporation). This lens is injection molded and consists of a precisely formed array of hemispherical refractive elements on both the upper and lower surfaces thereof. These elements freely transmit light downwardly while intercepting potential glaring rays and redirecting them into the conical beam.

U.S. Pat. No. 3,763,369 discloses the details of this refractive grid lens and is hereby incorporated by reference.

The overall combination provided by the above disclosed downlight, while quite effective in providing reasonably uniform illumination within the conical beam, provides a spacing to mounting height ratio of 1.5. That is, in order to provide uniform illumination to the work plane a series of such downlights must be spaced about $1\frac{1}{2}$ times their mounting height from one another. Unfortunately, industrial buildings are now being constructed with relatively low ceiling heights. Also, such new industrial buildings or industrial buildings being refurbished tend to have "finished ceilings" further lowering the maximum mounting height for downlights. With the advent of H.I.D. (high intensity discharge) light sources, higher lighting levels provided by these sources require that the units be spread out further in order to avoid providing higher than required illumination at the work plane. Thirdly, despite the ability of such downlights to provide higher illumination levels, there is a trend to design for even lower levels than in the past, with an eye to the energy shortage and the higher cost of providing electrical energy to maintain such lighting levels.

BRIEF SUMMARY OF THE INVENTION

Applicant's invention provides a downlight which permits, when used in conjunction with an array of identical downlights, wider spacing between adjacent fixtures while maintaining remarkably uniform lighting levels at the work plane.

Accordingly, Applicant has invented a downlight having a reflector, which has an inner reflective surface having a shape of a surface of revolution and including an opening in the bottom thereof. A lamp is positioned within this reflector. A refractor is positioned below the lamp and in the opening of the reflector. The inner reflective surface of the reflector is divided into a first reflective portion and a second reflective portion. One of the reflective portions has a metallic specular finish, while the other of the reflective portions has a white finish. More particularly, the first reflective portion comprises an upper circumferential portion of the reflective surface and the second reflective portion is the remaining lower circumferential portion of the reflective surface. Preferably the upper reflective portion is provided with the white reflective finish.

Further, the surface of revolution (which defines the shape of the reflective surface of the reflector) is such that light emanating from the lamp and reflected thereby, together with light from the lamp passing directly through the opening, forms a beam of generally right circular conical shape. The refractive lens includes means for refracting this beam to form a beam having a generally square cross section, at least at a reasonable distance below the position of the downlight.

BRIEF DESCRIPTION OF THE DRAWINGS

FIG. 3 is a graph showing one aspect of the performance of the luminaire according to the instant invention.

DETAILED DESCRIPTION OF THE INVENTION

Figure 1:
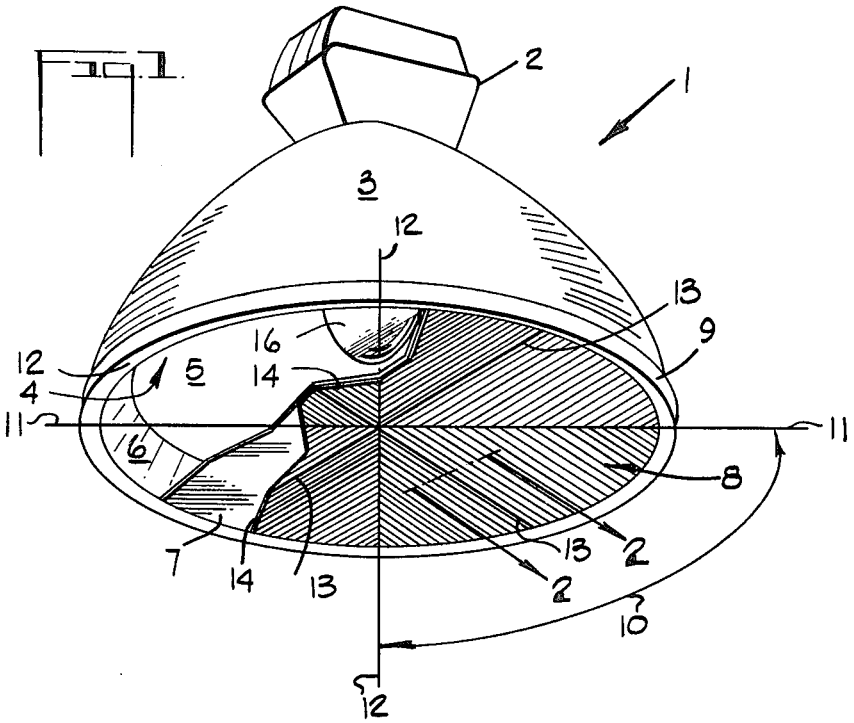
FIG. 1 is a perspective view of the luminaire according to the instant invention.

Turning to the drawings wherein like numerals refer to like structures throughout, FIG. 1 shows a downlight 1 with a portion of the optical assembly broken away to show the inner details thereof. Ballast capsule 2 is attached to the upper portion thereof and includes the usual electrical components associated with an H.I.D. (mercury, metal halide, or high pressure sodium) lamp 16. Capsule 2 also has means for mechanically suspending luminaire or downlight 1 in the pendant, downwardly facing orientation shown. Reflector 3 has an inner reflective surface 4 and is preferably of spun aluminum with a corrosion resistant outer finish. Reflector 3, and thus inner reflective surface 4, has a shape corresponding to a surface of revolution, with lamp 16 positioned on the axis thereof. Preferably the surface of revolution is of a substantially parabolic form. More particularly, surface 4 is in the shape of a parabaloid which reflects light from lamp 16 in parallel rays at 45° angles from nadir. These reflected rays pass through the axis of reflector 3 and normally form a cone of light, described by this 45° angle, having a circular cross section. It is this conical beam of normally downwardly directed light that is manipulated by the inventive structure to produce the desired illumination properties.

Positioned at the opening of the lower end of reflector 3 is a transparent refractive lens 8. Since this lens is usually constructed of an acrylic plastic, a heat absorbing glass plate 7 is positioned above lens 8 to protect it from heat generated from the lamp 16. Lens 8 includes refractive prism elements 14 and diffusing elements 15 defined on its upper surface. These elements will be more fully explained with reference to the other figures. Completing the mechanical features of luminaire 1 is a sealing ring 9 which removably attaches refractive lens 8 and the glass 7 to the outer rim of reflector 3.

Inner reflective surface 4 is chemically treated to provide a metallic specular reflective surface. While any of the notorious processes may be used, Applicant prefers the ALZAK process, which comprises etch, chemical polish, and anodizing steps. The upper circumferential portion 5 is provided with a white finish preferably by a baked enamel having a reflectance of between 88% and 92%. In this way, different percentages of the total reflective surface can be made to either have a white or a metallic specular reflective finish by simply varying the distance which the upper portion 5 extends downwardly towards the opening of reflector 3. Hence, when portion 5 comprises a relatively small percentage of the total area of reflective surface 4, the rest of the reflective surface 4 would comprise a relatively large, lower portion 6 having a metallic specular finish. This configuration would have particular optical qualities, hence its effect on the conical beam mentioned above would be different than that of a configuration having upper portion 5 extending down a considerable distance along the reflective surface 4 and hence would comprise a relatively large percentage of the total reflective surface 4. This is the result of a relatively small lower portion 6.

The effect of providing upper white reflective portion 5 is to increase the illumination to the floor or work plane at or close to nadir, i.e., near the axis directly below the suspended down light 1. An absence of or a reduction in the area of portion 5 consequently reduces the amount of illumination directly below the downlight 1 by operation of the specular portion 6 directing light outwardly. The relative percentages of the total reflective surface 4 provided by upper portion 5 and lower portion 6 can be varied quite easily between such extremes with concomitant manipulations in the optical performance of the overall luminaire 1.

The significance of the above manipulation can best be understood when the ultimate use of the luminaire 1 is taken into account. As a downlight, the present invention is intended to be suspended from ceiling height (or not far there below) to illuminate the floor or work plane beneath the ceiling. As stated above, this use is subject to design restraints, e.g., lower ceiling heights, higher efficiency of the individual lamps 16 resulting in higher lamp intensity, and lowered overall required illumination levels. It would be desirable to increase the spacing between adjacent downlights to economically utilize these high efficiency light sources. However, because of the conical beam produced, a downlight such as the LOBAY PRISMPACK I downlight mentioned above can only be spaced about 1.3 to 1.5 times its mounting height from the next adjacent downlight before light falloff between the conical beams eminating therefrom becomes unacceptable. For example, it has been found that to produce acceptably uniform light levels at the floor or work plane, prior art downlights suspended at 10 m above the floor or work plane should be spaced from one another about 15 m. Thus, the ratio of luminaire spacing to mounting height is 1.5 and is usually a fixed performance parameter of the particular downlight configuration.

More particularly, the spacing to mounting height ratio is expressed in terms of a "Spacing Criterion" (SC) which requires that the illumination at the floor or work plane, provided by an array of four such downlights at the point midway between two such downlights, or at the point in the middle of the array of four lights, should be about equal to the illumination directly below one of the downlights (i.e., at about nadir). The spacing to mounting height ratio dictated by the "Spacing Criterion" usually results in a closer spacing distance (for a given height) than would otherwise be required since the light at the center of the array of four is less intense because of the light falloff at the edge of the four conical beams provided thereby. While four such beams are contributing to the illumination at the central point of the array of four downlights, the lights must be moved closer together to make up for the light falloff of the four contributing beams.

It is this performance criteria, i.e., Spacing Criterion, that the lens, together with the incrementally painted reflector 3, meets in a superior manner.

Figure 2:
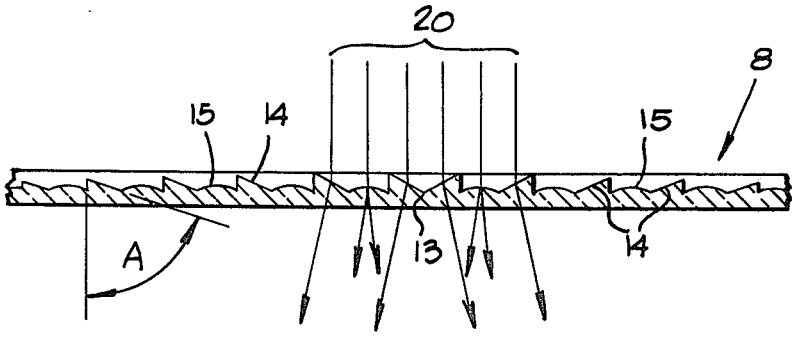
FIG. 2 shows a portion of the refractive lens thereof in cross section.

Lens 8 is comprised of four quadrants 10 joined together along their edges to form the overall circular lens. Each quadrant is defined by a series of linear optical elements defined in the contour of the upper surface thereof. These elements, as stated above, are linear in form and are of generally uniform cross section along their length, and from quadrant to quadrant. They are parallel to the radial bisector 13 which bisects each quadrant 10. The array of optical elements are symmetrical with respect to this bisector 13. Seen in more detail in FIG. 2, these elements comprise prismatic refractor elements 14 alternating in position with light diffusing elements 15 across substantially the entire area defined by each quadrant 10. Elements 14 on one side of radial bisector 13 face in the opposite direction from those prismatic elements 14 on the other side of radial bisector 13 and deflect light rays 20 generally away from bisector 13 towards diagonal axis 11 and 12 (shown in FIG. 1). By redirecting selected portions of the light passing through lens 8 away from bisectors 13, and hence towards diagonal axes 11 and 12, the normally circular cross section of the beam produced by reflector 3 and lamp 16 is reshaped to approximate a square.

One can imagine an array of four such downlights 1 each having the capability of producing a pyramidal beam of light. By orienting one or the other diagonal axis 11 or 12 towards the center point of such array of four, the spacing criteria can be more easily met. As each such downlight 1 in the array has lens 8 providing more light towards those diagonal axis, more light from each of the downlight would be provided to the center point of the array. This permits the downlights to be spaced farther apart than would otherwise be possible.

A further detail of lens 8 is that the angle A formed between the upper face of elements 14 and perpendicular to the plane of the lens increases with the distance between that particular element and bisector 13. Thus, this refracting effect decreases progressively with the distance from bisector 13. In the preferred embodiment, angle A (FIG. 2) is about 54° for the elements 14 immediately adjacent bisectors 13. This angle A increases in increments to about 74.4° for elements 14 furthest away from the bisectors 13. The general design criteria for these elements are set forth in greater detail in U.S. Pat. No. 3,344,268, assigned to the assignee of the present invention, which patent is hereby incorporated by reference.

Light diffusing elements 15 operate to soften harsh shadows which would otherwise be formed by the refracting effect of elements 14. Elements 15 are defined by an upper curved surface having a preferred radius of about 0.369. In contrast to elements 14, elements 15 are of consistant cross section relative to one another across each quadrant 10. Preferably the last six elements in each quadrant (i.e., those elements closest to the diagonals 11 and 12) are diffusing elements 15.

Using the preferred embodiment of Applicant's invention, the spacing required to provide the proper light intensity at the center point of the array of four downlights is substantially the same as would be required to provide the proper light intensity between two such downlights, thus overcoming the problem which has existed in the prior art.

In FIG. 3, curve 30 shows the effect of changing the area covered by white reflective paint. The X axis of the graph shows the percent of total reflective surface 4 that the upper portion 5 contributes. As the area of upper portion 5 increases, the illumination near nadir increases. Consequently the spacing to mounting height ratio decreases to approximate that of the prior art LOBAY PRISM PACK I downlight. However, as the size of the upper portion 5 decreases, the illumination near nadir provided thereby decreases and hence the spacing to mounting height ratio increases to a theoretical maximum of three. Thus, incremental painting of reflective surface 4 provides a valuable tool for providing downlights with particular spacing to mounting height capabilities. While theoretically one could provide an infinite number of spacing to mounting height downlight configurations, as practical matter Applicant has found it desirable to only provide downlights with selected spacing to mounting height capabilities. Such downlights are commercially provided for 2.0 SC, 1.8 SC, 1.5 SC and 1.3 SC applications, (corresponding to upper portion percentages of 20%, 40%, 60% and 80% respectively) although the inventive concept permits greater flexibility than the market demands at this time. However, this very flexibility permits the elimination or addition of other spacing criteria with a relatively minor change in the production process e.g., altering the relative coverage of painted upper portion 5.

While the spacing to mounting height ratio has been universally accepted as part of the specifications for factory lighting and similar lighting situations, other performance parameters are being closely looked at. One such performance parameter is used in, for example, parking lot lighting situations. This performance parameter compares minimum ilumination to the maximum illumination provided by a particular lighting setup (e.g., an array of downlights). Also used is a comparison of minimum illumination to average illumination provided by a lighting set-up.

Figure 4:
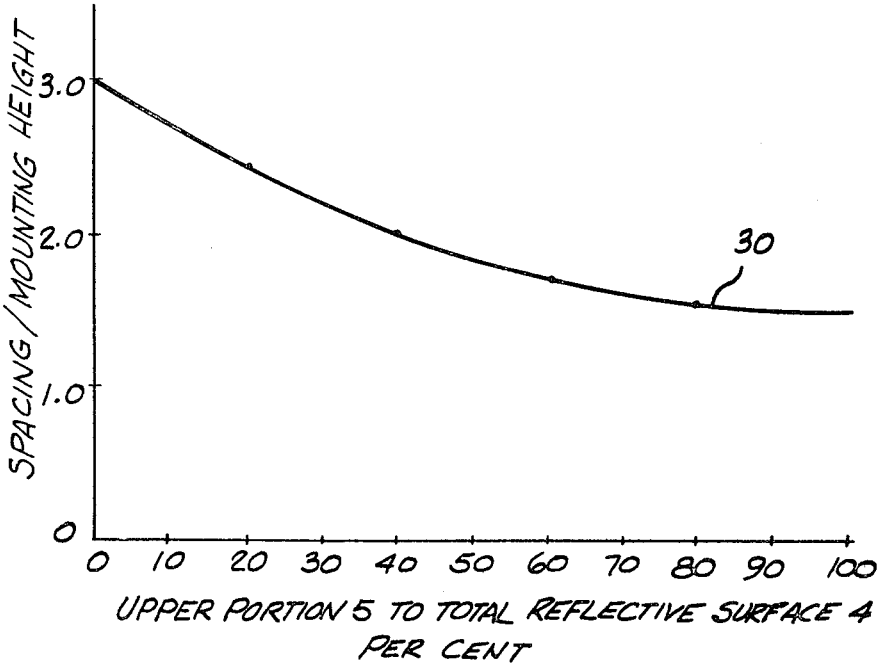
FIG. 4 shows a further aspect of the performance of the lamp according to the instant invention.
Figure 4:
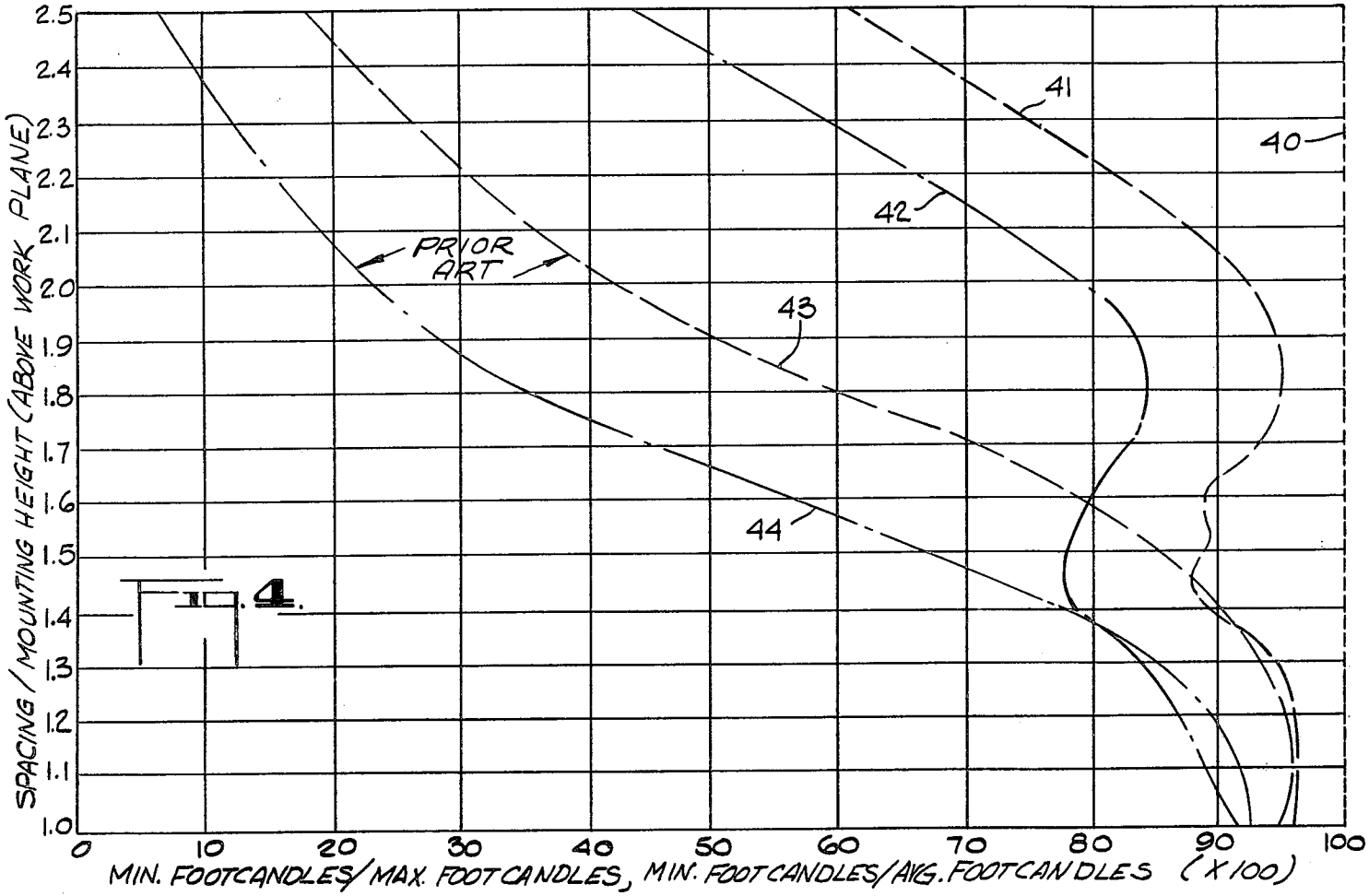

FIG. 4 is a graph showing these two performance parameters (the ratios min/max and min/average) for a range of spacing to mounting height ratios for the prior art LOBAY PRISMPACK II downlight and a downlight in accordance with the instant invention. The minimum to maximum ratio is expressed in a ratio of foot candles, times 100 to give the dimensions along the X axis of the graph. A "perfect" lighting arrangement would have no variation in illumination, hence a graphical representation of a perfect lighting arrangement on this graph would be positioned at the "100" position along the X axis (i.e., the ratio of minimum to average and minimum to maximum would be unity, times 100 would give 100 on the X axis). A downlight capable of such "perfect" light distribution, and also having th capability of generating this perfect light distribution in a number of different spacing to mounting height ratio configurations, would show as a straight line at the "100" position extending between whatever spacing to mounting height ratios at which it displays this perfect performance. Such a perfect and versatile lighting arrangement is shown as dotted line 40 in FIG. 4. Lines 41 and 42 show the minimum/average and minimum/maximum ratios for the downlights according to the instant invention. Lines 43 and 44 represent the corresponding ratios for the prior art system.

Clearly, the downlights in accordance with the present invention exhibit a performance far superior to that demonstrated by the prior art downlight. The downlights according to the instant invention produce quite uniform light and are able to do this in a number of spacing situations. This uniformity of light distribution and versatility makes the downlight in accordance with the instant invention a desirable lighting tool in today's very demanding lighting market.

I claim:

1. A luminaire for use as a downlight comprising a reflector including an inner reflective surface having a shape corresponding to a surface of revolution and including an opening in the bottom thereof; a lamp positioned within said reflector; a refractive lens positioned below said lamp and in said opening of said reflector; said inner reflective surface is divided into a first reflective portion and a second reflective portion, one of said reflective portions having a metallic specular finish, the remaining portion of said reflective portions having a white finish.

2. A luminaire as set forth in claim 1 wherein said first reflective portion is an upper circumferential portion and said second reflective portion is a lower circumferential portion.

3. A luminaire as set forth in claim 2 wherein said upper reflective portion has said white reflective finish, and said lower reflective portion has said metallic specular finish.

4. A luminaire as set forth in claim 3 wherein said upper reflective portion has a surface area of between about 20% and about 80% of the total surface area of said inner reflective surface.

5. A luminaire as set forth in claim 3 wherein said surface area of said upper reflective portion is about 40% of the total surface area of said inner reflective portion.

6. A luminaire as set forth in claim 3 wherein said upper reflective portion has a surface area of about 60% of the total surface area of inner reflective surface.

7. A luminaire as set forth in claim 3 wherein said upper reflective portion has a surface area of about 80% of the total surface area of said inner reflective surface.

8. A luminaire as set forth in any of claims 1–7 having optical characteristics to meet a spacing criteria greater than or equal to 1.5.

9. A luminaire as set forth in any of claims 1–7 wherein said surface of revolution is such that light eminating from said lamp and reflected from said surface forms a generally right circular conical beam, said lens includes means for refracting said beam to form a beam having a cross section approximating a square at a distance below said luminaire.

10. A luminaire as set forth in claim 9 wherein said lens is divided into four quadrants, said means for refracting includes prismatic refractor elements in each said quadrants, said refractive elements extending parallel to the radial bisector of said quadrant.

11. A luminaire as set for in claim 10 wherein said means for refracting further includes light diffusing elements positioned between said prismatic refractor elements.

* * * * *